US010111573B2

(12) United States Patent
Boyer

(10) Patent No.: US 10,111,573 B2
(45) Date of Patent: Oct. 30, 2018

(54) ADAPTER AND SPRAY ASSEMBLY FOR A DISHWASHER APPLIANCE

(71) Applicant: General Electric Company, Schenectady, NY (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 347 days.

(21) Appl. No.: 14/847,401

(22) Filed: Sep. 8, 2015

(65) Prior Publication Data

US 2017/0065147 A1 Mar. 9, 2017

(51) Int. Cl.
*A47L 15/23* (2006.01)
*A47L 15/42* (2006.01)

(52) U.S. Cl.
CPC ..... *A47L 15/23* (2013.01); *A47L 15/4221* (2013.01); *A47L 15/4289* (2013.01); *A47L 2401/20* (2013.01); *A47L 2501/03* (2013.01); *A47L 2501/20* (2013.01)

(58) Field of Classification Search
CPC .. A47L 15/23; A47L 15/4221; A47L 15/4289; A47L 2401/20; A47L 2501/03; A47L 2501/20
USPC ..... 134/56 D, 57 D, 58 D, 174, 184, 200
See application file for complete search history.

(56) References Cited

U.S. PATENT DOCUMENTS 8,592,519 B2 11/2013 Martinoni
2014/0190534 A1* 7/2014 Boyer ..... A47L 15/4282 134/198
2015/0090306 A1 4/2015 Boyer

* cited by examiner

*Primary Examiner* — Levon J Shahinian
(74) *Attorney, Agent, or Firm* — Dority & Manning, P.A.

(57) ABSTRACT

Adapters and spray arm assemblies for dishwasher appliances are provided. An adapter defines an axial direction, a radial direction, and a circumferential direction. The adapter includes a base unit. The base unit includes an inlet housing defining an inlet annulus. The base unit further includes a first conduit extending from the inlet housing and comprising a passage defined between an inlet and an outlet. The base unit further includes a second conduit extending from the inlet housing and comprising a passage defined between an inlet and an outlet. The entire passage of the first conduit and the entire passage of the second conduit each extend at an angle to the axial direction of less than or equal to 60 degrees.

20 Claims, 8 Drawing Sheets

ADAPTER AND SPRAY ASSEMBLY FOR A DISHWASHER APPLIANCE

FIELD OF THE INVENTION

The present subject matter relates generally to dishwasher appliances and spray assemblies for the same, and more particularly to improved adapters for flowing wash fluid to spray arms in dishwasher appliances.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. The spray assemblies can include a lower spray assembly mounted to the tub at a bottom of the wash compartment, a mid-level spray assembly mounted to one of the rack assemblies, and an upper spray assembly mounted to the tub at a top of the wash compartment.

The spray assemblies can each include spray arms that rotate and direct wash fluid onto articles in the rack assemblies. Generally, such spray arms are mounted to the spray assemblies using fasteners that extend through the spray arm into other components of the spray assemblies or the tub. In alternative designs, the spray arms can be secured onto the spray assemblies using snap fit connections.

Certain spray assemblies are configured to rotate in two directions. Mounting such spray assemblies using fasteners or snap fit connections can be problematic. For example, the fasteners and/or snap fit connectors can work loose over time, particularly when the spray assemblies change direction. Thus, the spray assemblies can disconnect or leak over time due to the attachment mechanism working loose.

On solution which advantageously hinders undesired detachment of a spray arm of the spray assembly is provided by U.S. patent application Ser. No. 13/736,327, filed on Jan. 8, 2013 and entitled "A Spray Assembly for a Dishwasher Appliance", which is incorporated by reference in its entirety herein.

However, further spray assembly improvements could be made. For example, it would be desirable to reduce pressure losses for wash fluid flowing through spray assemblies to the spray arms, to improve the operation of the spray arms. Further, it would be desirable to reduce the time and difficulty associated with assembly of a spray assembly in a dishwasher appliance. Accordingly, improved adapters and spray arm assemblies for dishwasher appliances are desired.

BRIEF DESCRIPTION OF THE INVENTION

In accordance with one embodiment, an adapter for flowing wash fluid to a spray arm in a dishwasher appliance is provided. The adapter defines an axial direction, a radial direction, and a circumferential direction. The adapter includes a base unit. The base unit includes an inlet housing defining an inlet annulus. The base unit further includes a first conduit extending from the inlet housing and comprising a passage defined between an inlet and an outlet. The base unit further includes a second conduit extending from the inlet housing and comprising a passage defined between an inlet and an outlet. The entire passage of the first conduit and the entire passage of the second conduit each extend at an angle to the axial direction of less than or equal to 60 degrees.

In accordance with another embodiment, a spray assembly for a dishwasher appliance is provided. The spray assembly defines an axial direction, a radial direction, and a circumferential direction. The spray assembly includes an adapter for flowing wash fluid to a spray arm in a dishwasher appliance. The adapter includes a base unit. The base unit includes an inlet housing defining an inlet annulus. The base unit further includes a first conduit extending from the inlet housing and comprising a passage defined between an inlet and an outlet. The base unit further includes a second conduit extending from the inlet housing and comprising a passage defined between an inlet and an outlet. The entire passage of the first conduit and the entire passage of the second conduit each extend at an angle to the axial direction of less than or equal to 60 degrees. The adapter further includes a mounting bracket, the mounting bracket including an annular sidewall which includes an inner surface and an outer surface, the annular sidewall defining a plurality channels. The spray assembly further includes a spray arm in fluid communication with the adapter, the spray arm removably fastened to the mounting bracket.

In accordance with another embodiment, a dishwasher appliance is provided. The dishwasher appliance includes a tub that defines a wash compartment, a rack assembly mounted within the wash compartment of said tub and configured for receipt of articles for washing, and a spray assembly for applying wash fluid to articles within said rack assembly. The spray assembly defines an axial direction, a radial direction, and a circumferential direction. The spray assembly includes an adapter for flowing wash fluid to a spray arm in a dishwasher appliance. The adapter includes a base unit. The base unit includes an inlet housing defining an inlet annulus. The base unit further includes a first conduit extending from the inlet housing and comprising a passage defined between an inlet and an outlet. The base unit further includes a second conduit extending from the inlet housing and comprising a passage defined between an inlet and an outlet. The entire passage of the first conduit and the entire passage of the second conduit each extend at an angle to the axial direction of less than or equal to 60 degrees. The adapter further includes a mounting bracket, the mounting bracket including an annular sidewall which includes an inner surface and an outer surface, the annular sidewall defining a plurality channels. The spray assembly further includes a spray arm in fluid communication with the adapter, the spray arm removably fastened to the mounting bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
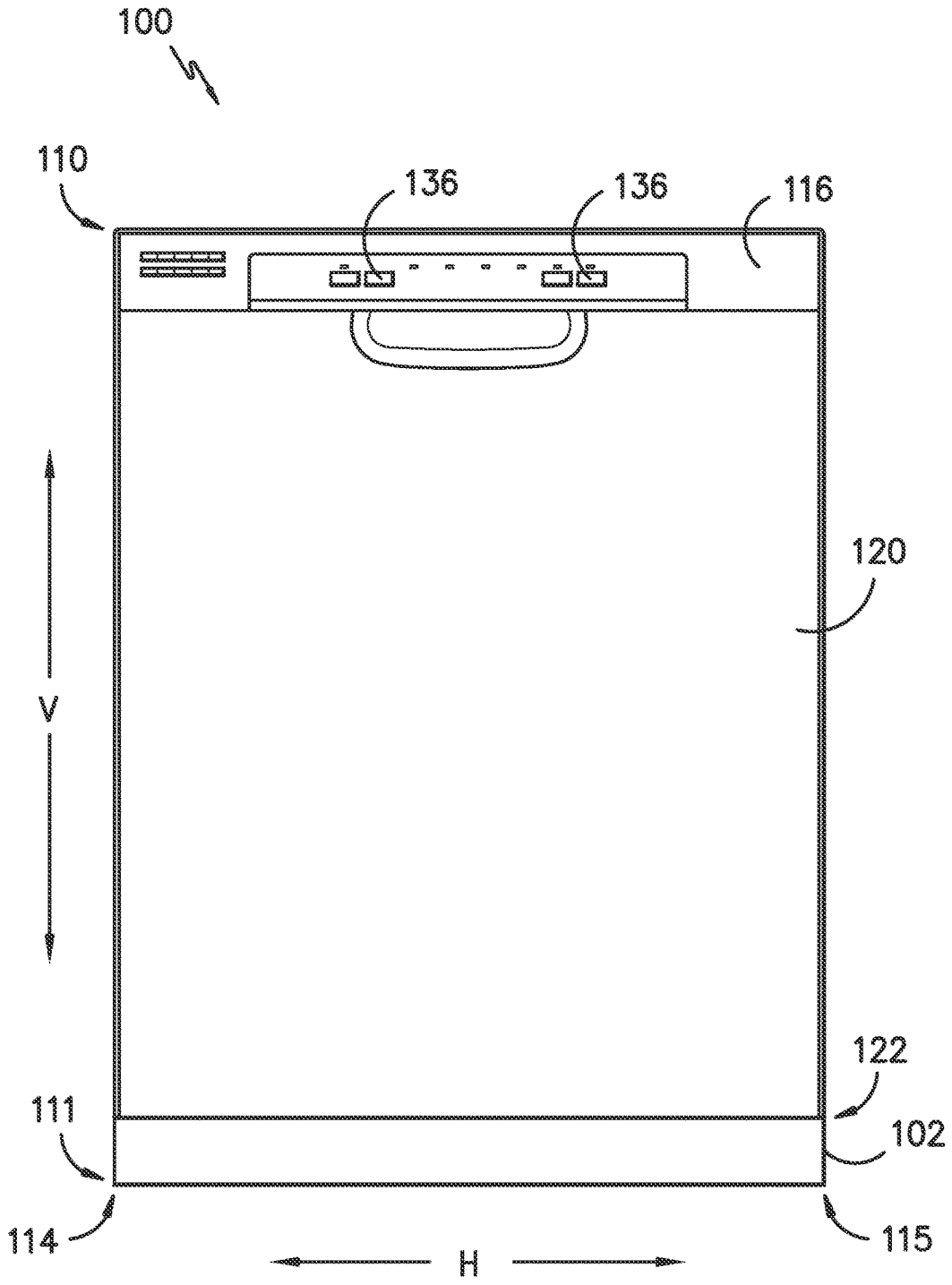
FIG. 1 provides a front elevation view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
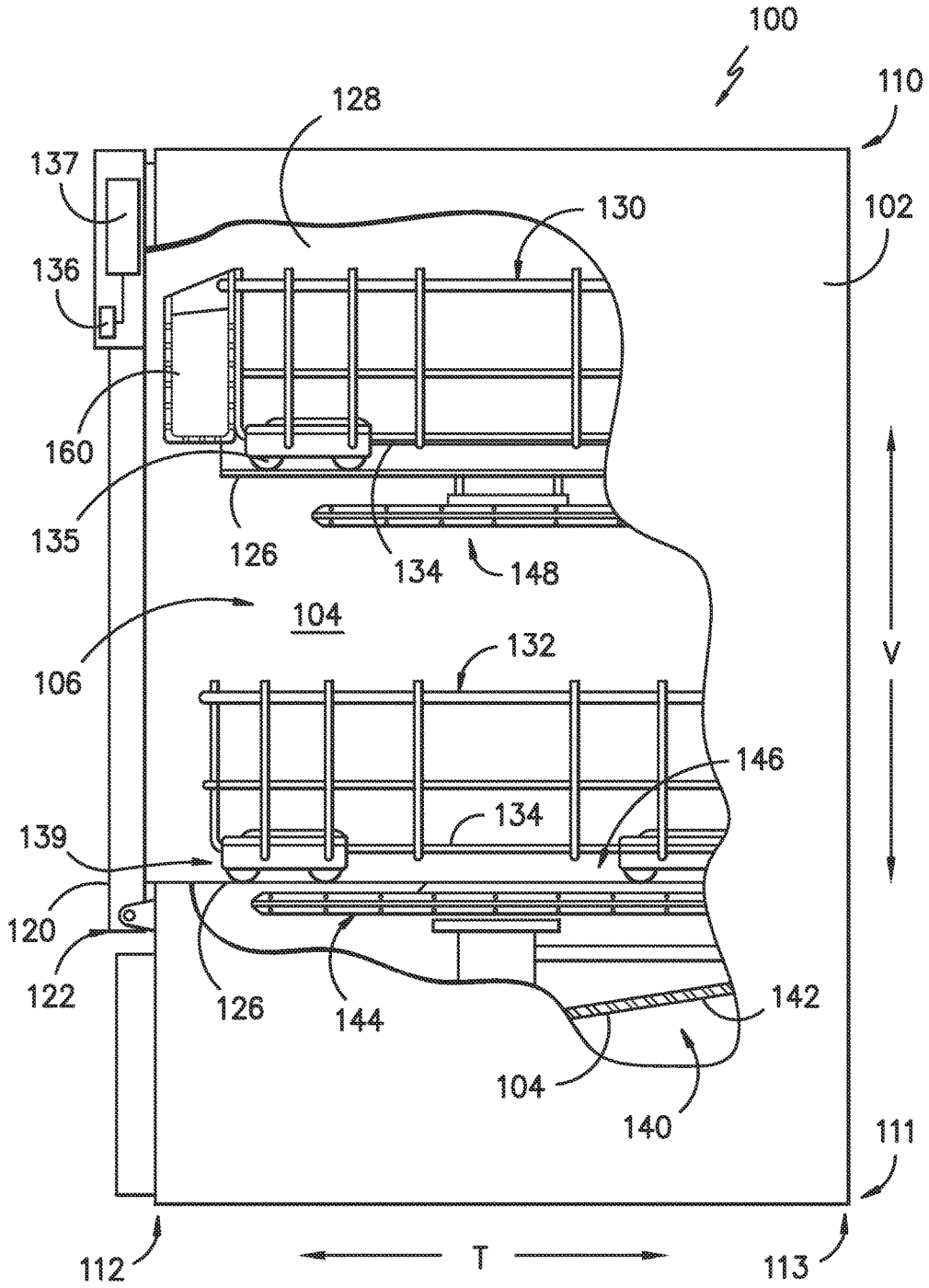
FIG. 2 illustrates a section view of the dishwasher appliance of FIG. 1.

FIGS. 1 and 2 depict a dishwasher appliance 100 according to an exemplary embodiment of the present subject matter. The dishwasher appliance 100 includes a cabinet 102 having a tub 104 therein that defines a wash compartment 106. Tub 104 also includes a door 120 hinged at its bottom 122 for movement between a normally closed configuration (shown in FIGS. 1 and 2) in which wash compartment 106 is sealed shut, e.g., for washing operation, and an open configuration, e.g., for loading and unloading of articles from dishwasher appliance 100.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

Turning to FIG. 2, guide rails 126 are mounted on tub side walls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash compartment 106, and a retracted position (shown in FIGS. 1 and 2) in which the rack is located inside the wash compartment 106.

A silverware basket 160 is removably mounted to upper rack assembly 130. However, silverware basket 160 may also be selectively attached to other portions of dishwasher appliance 100, e.g., lower rack 132 or door 120. Silverware rack 160 is configured for receipt of silverware, utensils, and the like, that are too small to be accommodated by the upper and lower racks 130, 132.

The dishwasher appliance 100 further includes a lower spray assembly 144 that is mounted within a lower region 146 of the wash compartment 106 and above a tub sump portion 142 so as to be in relatively close proximity to the lower rack 132. A mid-level spray assembly 148 is located in an upper region of the wash compartment 106 and may be located in close proximity to upper rack 130. Additionally, an upper spray assembly (not shown) may be located above the upper rack 130. The lower and mid-level spray assemblies 144, 148 and the upper spray assembly are fed by a fluid circulation assembly (not shown) for circulating water and wash fluid (e.g., detergent, water, and/or rinse aid) in the tub 104. The fluid circulation assembly may be located in a machinery compartment 140 located below the bottom sump portion 142 of the tub 104, as generally recognized in the art.

Each spray assembly includes an arrangement of discharge ports or orifices for directing washing liquid onto dishes or other articles located in the upper and lower racks 130, 132 and silverware basket 160. The lower and mid-level spray assemblies 144, 148 may be rotatably mounted in wash compartment 106. Accordingly, the arrangement of the discharge ports in at least the lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel 116 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations.

Referring now to FIGS. 3 through 8, embodiments and components of a spray assembly 180 in accordance with the present disclosure are provided. Spray assembly 180 may be used in dishwasher washer appliance 100, e.g., as lower spray assembly 144.

Spray assembly 180 includes an adapter 182, as illustrated in FIGS. 5 through 8. The adapter 182 may, when assembled in spray assembly 180 and dishwasher appliance 100, be mounted or secured to tub 104, e.g., at tub sump portion 142, or another suitable component of dishwasher appliance 100 such as a diverter 170 as illustrated. For example, as illustrated, diverter 170 includes an inlet 172 through which wash fluid is flowed from a sump of the dishwasher appliance for flowing into wash compartment 106. Diverter 170 may selectively provide the wash fluid to one of a plurality of passages of the adapter 182.

Figure 3:
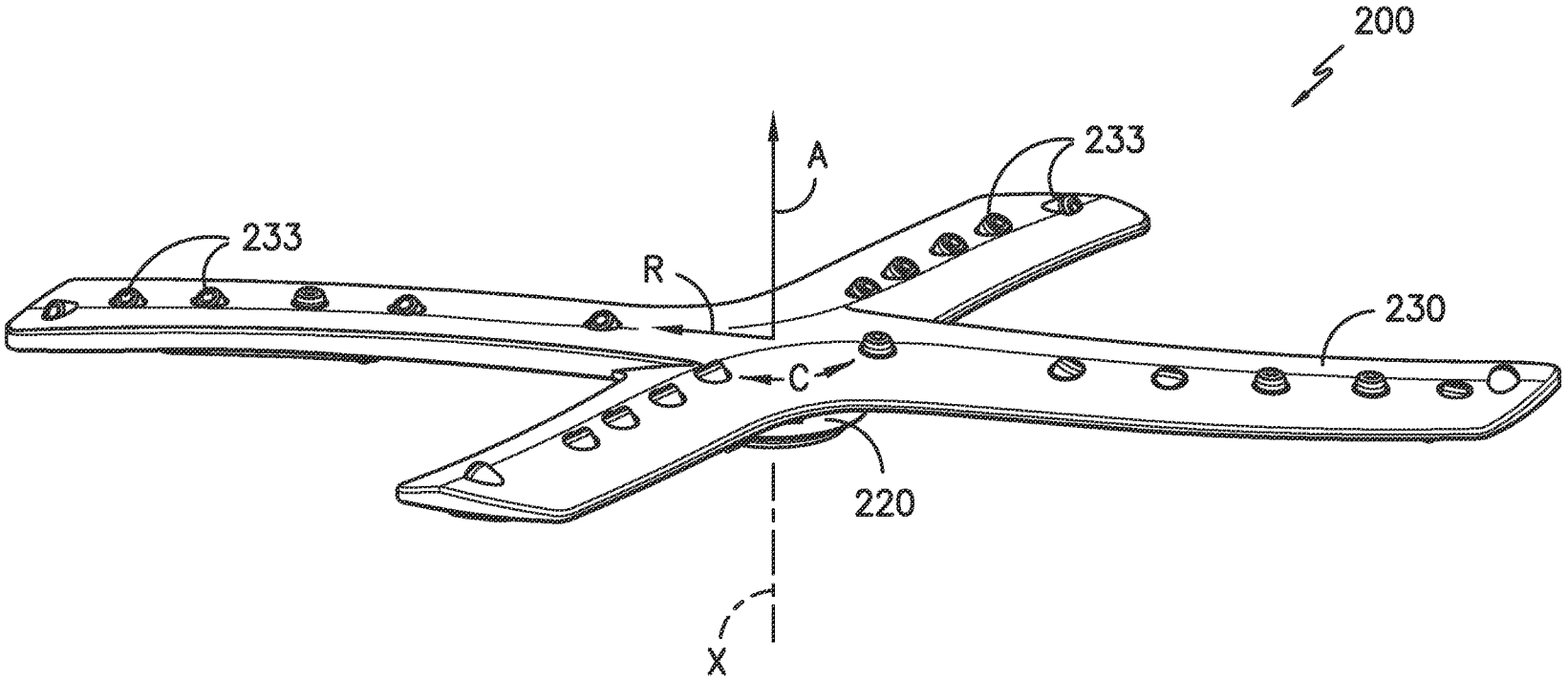
FIG. 3 provides a top perspective view of a spray arm in accordance with one embodiment of the present disclosure.
Figure 4:
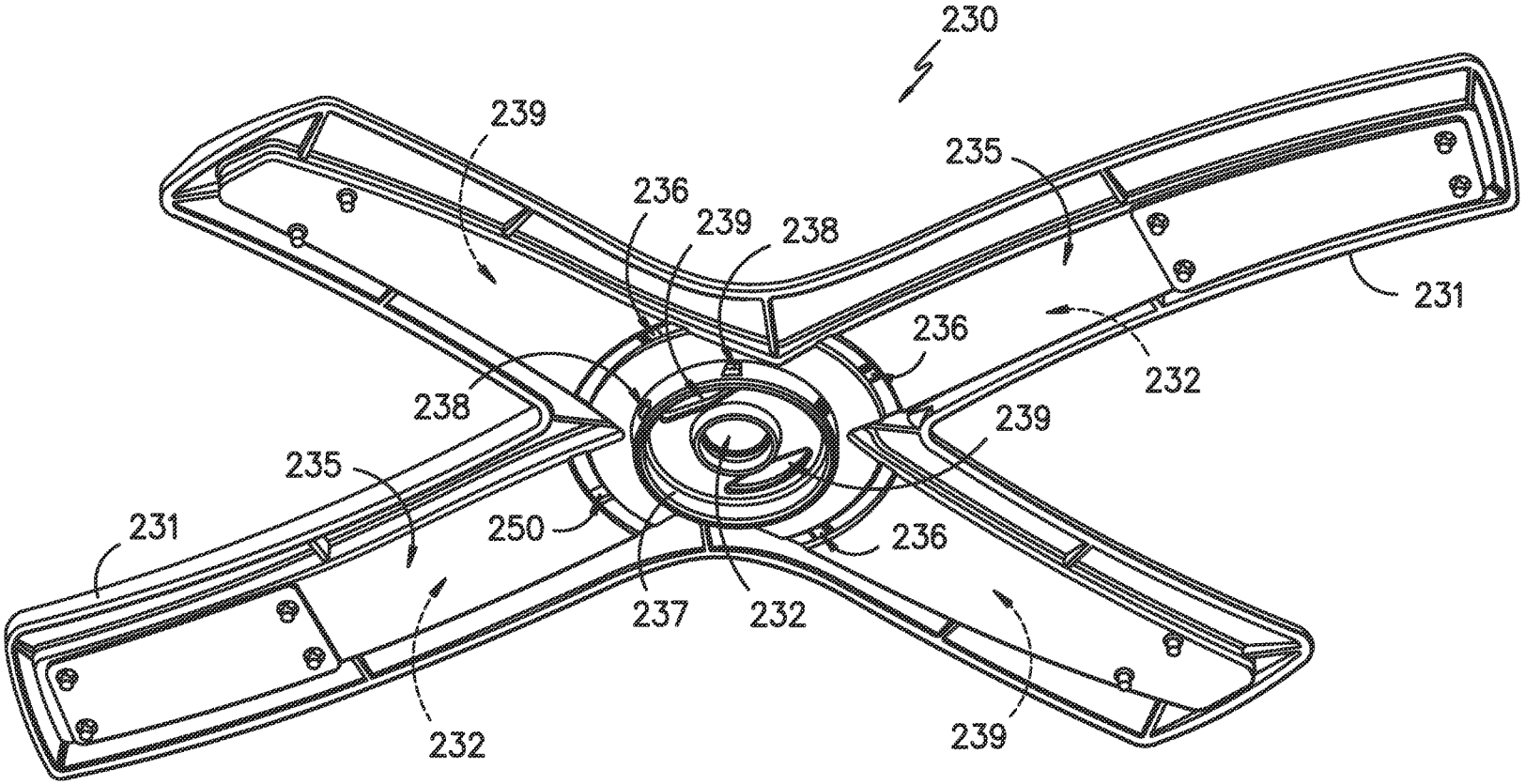
FIG. 4 provides a bottom perspective view of a spray arm in accordance with one embodiment of the present disclosure.
Figure 5:
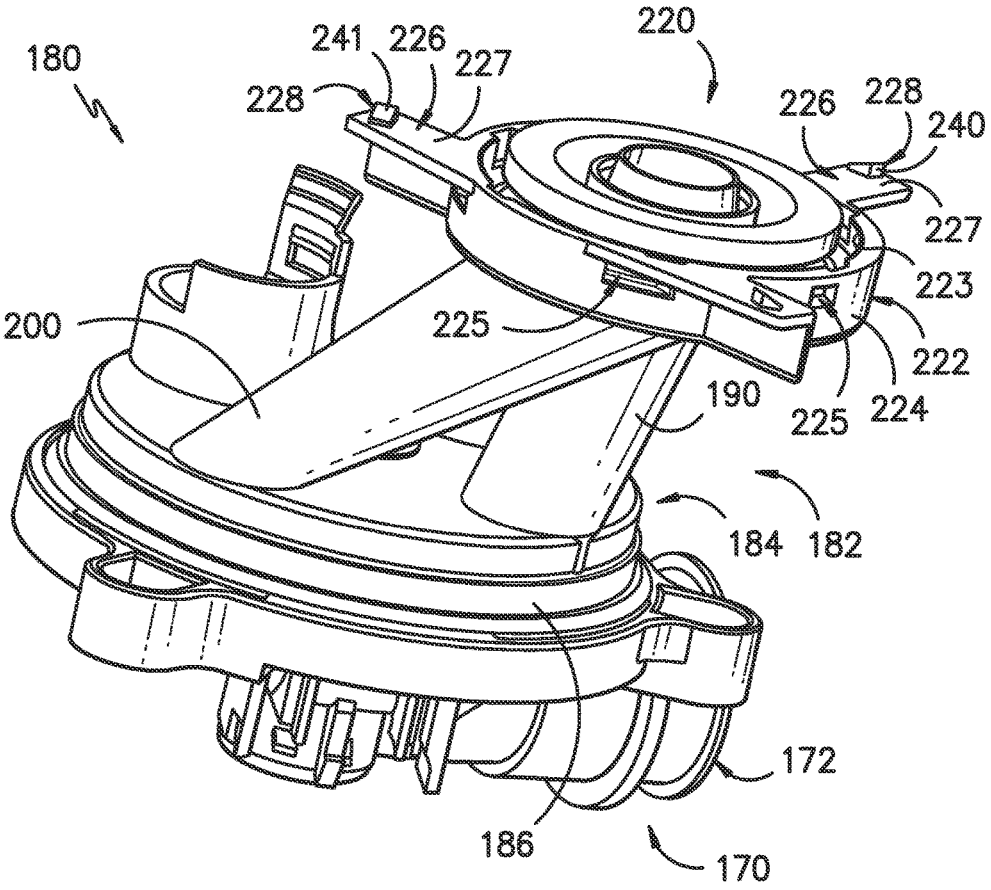
FIG. 5 provides a perspective view of an adapter and diverter in accordance with one embodiment of the present disclosure.
Figure 6:
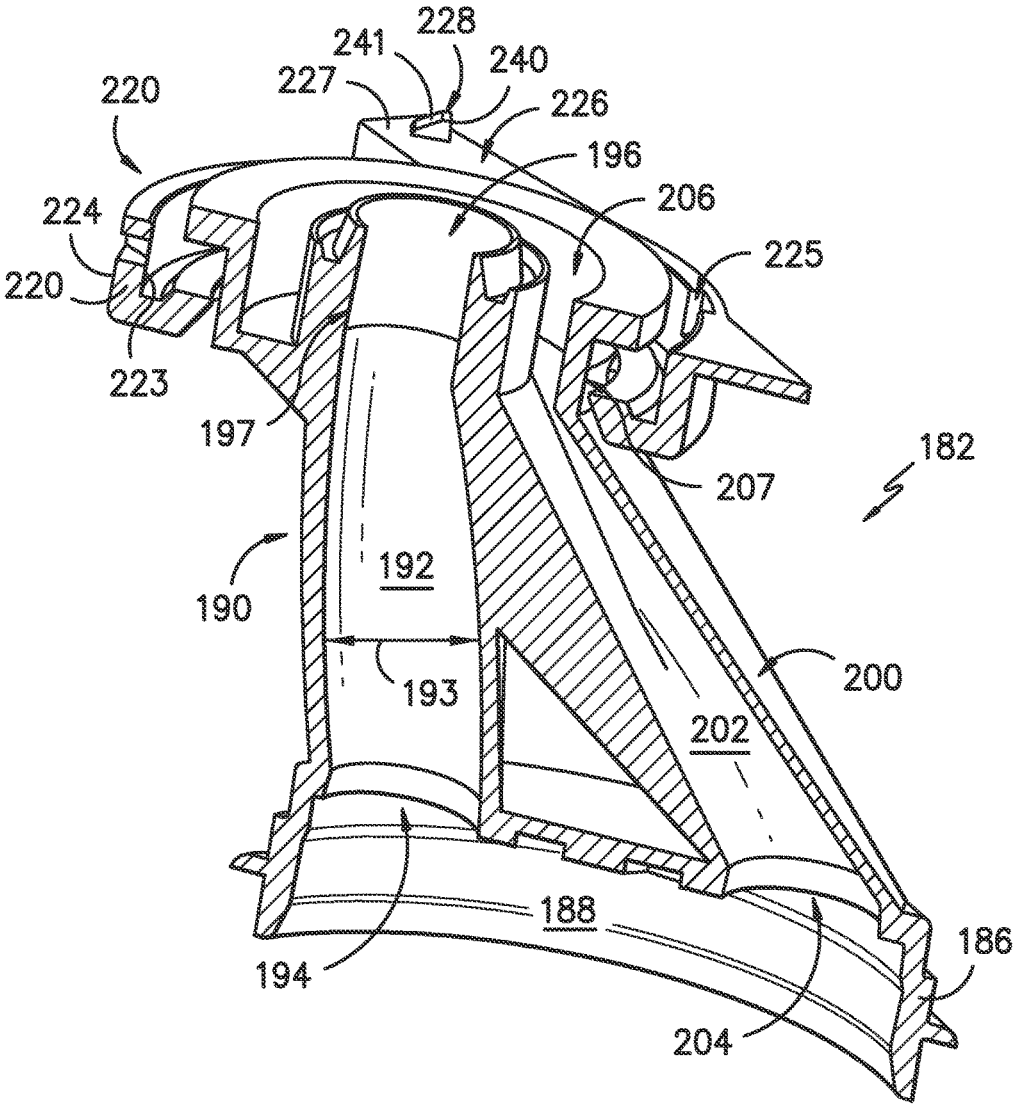
FIG. 6 is a sectional view of an adapter in accordance with one embodiment of the present disclosure.
Figure 8:
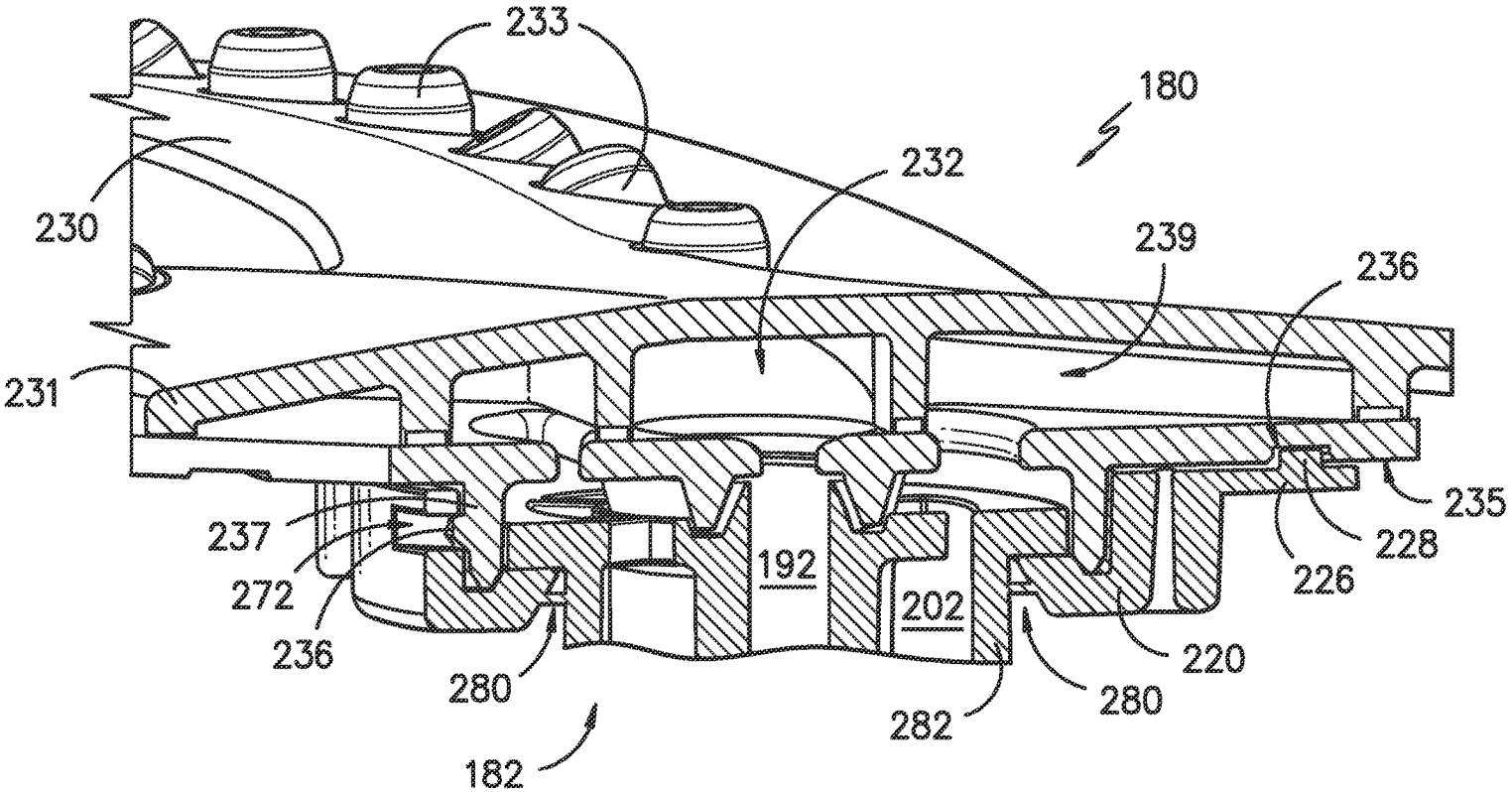
FIG. 8 is a partial sectional view of a spray assembly, including a spray arm and adapter, in accordance with one embodiment of the present disclosure.

Referring now to FIGS. 3, 4 and 8, a spray arm 230 may be rotatably mounted to adapter 182. Spray arm 230 includes a main body 231 that defines a chamber 232. Chamber 232 is configured for receipt of wash fluid during operation of dishwasher appliance 100 (FIG. 1), i.e. from adapter 205. Main body 231 also includes a plurality of nozzles 233 that are in fluid communication with chamber 232 such that wash fluid within chamber 232 flows out of chamber 232 through plurality of nozzles 233. Plurality of nozzles 233 is configured to direct such wash fluid towards articles disposed within upper and lower rack assemblies 130 and 132 and/or silverware basket 150. Further, each nozzle of plurality of nozzles 233 can be directed in a particular direction to facilitate uniform distribution of wash fluid within wash compartment 106.

Referring again to FIGS. 5 through 8, adapter 182 may include a base unit 184. The base unit 184 may include an inlet housing 186 which defines an inlet annulus 188. The inlet housing 186 may, for example, be mounted to diverter 170 to received wash fluid from diverter 170. Base unit 184 may further include a first conduit 190 and a second conduit 200 extending from the inlet housing 186. The first conduit 190 includes a passage 192 defined and extending between an inlet 194 and an outlet 196. The second conduit 200 includes a passage 202 defined and extending between an inlet 204 and an outlet 206. Wash fluid may be flowed through the passages 192, 202 to the spray arm 230. In exemplary embodiments, for example, wash fluid may be selectively flowed from diverter 170 to and through the passages 192, 202. The inlets 194, 204 may thus for example, be in fluid communication with the inlet annulus 188 and may receive wash fluid from the inlet annulus 188 and/or diverter 170 or other component of dishwasher 100.

As discussed, wash fluid may be flowed through the passage 192, 202 to the spray arm 230. It is generally desirable for the wash fluid supplied to spray arm 230 to be at a relatively high pressure to facilitate suitable flow through and from the spray arm 230 into wash compartment 106. Adapters in accordance with the present disclosure advantageously facilitate such improved wash fluid flow. For example, in exemplary embodiments, the entire passage 192 (from inlet 194 to outlet 196) and the entire passage 202 (from inlet 204 to outlet 206) may each extend at an angle to an axial direction A of less than or equal to 60 degrees, such as less than or equal to 50 degrees. The entire passage 192 may, for example, extend at an angle to the axial direction A of less than or equal to 20 degrees, such as less than or equal to 15 degrees, such as less than or equal to 10 degrees. Wash fluid entering the passages 192, 202 may enter flowing generally along the axial direction A. The angles at which the passage 192, 202 extend may advantageously reduce pressure losses in the wash fluid as the wash fluid travels through the passages 192, 202. For example, sharp 90 degree turns are eliminated through usage of an adapter 182 in accordance with the present disclosure. The present inventors have discovered that the present adapter 182 designs in accordance with the present disclosure advantageously reduce pressure losses and increase spray assembly 180 performance.

Figure 7:
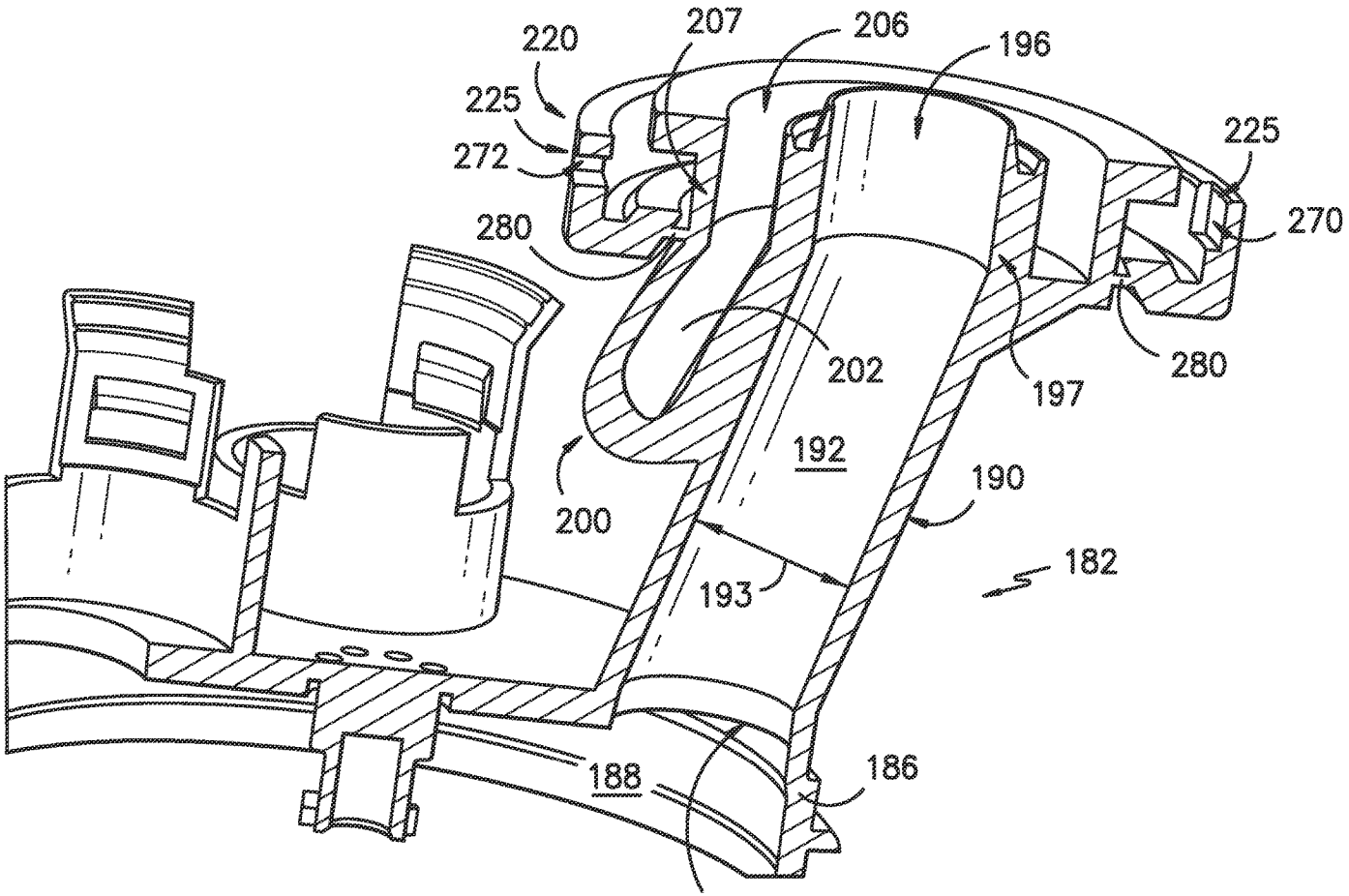
FIG. 7 is another sectional view of an adapter in accordance with one embodiment of the present disclosure.

In further exemplary embodiments, a cross-sectional area of the passage 192 is generally constant throughout the passage 192 from the inlet 194 to the outlet 196 (i.e. the entire passage 192), as illustrated in FIG. 7. For example, the cross-sectional area may be circular and defined by a diameter 193, as illustrated, or may have any other suitable shape. Additionally, in exemplary embodiments, the cross-sectional shape may be generally constant throughout the passage 192 from the inlet 194 to the outlet 196 (i.e. the entire passage 192). Alternatively, the cross-sectional area may change, such as for example by tapering through at least a portion of the passage 192 towards the outlet 196.

In further exemplary embodiments, a cross-sectional area of the passage 202 may taper throughout at least a portion of the passage 202 towards the outlet 206, such as from the inlet 204. Alternatively, the cross-sectional area of the passage 202 may be generally constant throughout the passage from the inlet 204 to the outlet 206 (i.e. the entire passage 202) or have any other suitable configuration.

As illustrated, in exemplary embodiments, outlet 206 generally surrounds outlet 196. Further, an end portion 207 of passage 202 which includes outlet 206 may generally surround an end portion 197 of passage 192 which includes outlet 197. As discussed herein, wash fluid flowed through and exhausted from outlet 196 may cause spray arm 230 to rotate in one direction, while wash fluid flowed through and exhausted from outlet 206 may cause spray arm 230 to rotate in a second opposite direction.

Adapter 184 may, in exemplary embodiments, additionally include a mounting bracket 220 for mounting the spray arm 230 and adapter 184 together. As illustrated, mounting bracket 220 includes an annular sidewall 222 that has an inner surface 223 and an outer surface 224. Annular sidewall 222 also defines a plurality of channels or radial slots 225. In exemplary embodiments, each channel of plurality of channels 225 extends through annular sidewall 222 from inner surface 223 to outer surface 224. Further, each channel of plurality of channels 225 includes an axial portion 270 that extends along the axial direction A and a circumferential portion 272 that extends along the circumferential direction C. Plurality of channels 225 are configured for assisting with mounting of spray arm 230 to base unit 182 as discussed herein.

A plurality of posts 226 is mounted to annular sidewall 222 and extends away from outer surface 224 of annular sidewall 222, e.g., along the radial direction R. In exemplary embodiments, posts of plurality of posts 226 are non-uniformly distributed about the circumferential direction C. Each post of plurality of posts 226 has an upper surface 227.

A tab or annular tab 228 is mounted on upper surface 227 of each post of plurality of posts 226. Tab 228 extends away from upper surface 227 of each post of plurality of posts 226, e.g., along the axial direction A. Each tab 228 has an engagement surface 240. Engagement surface 240 may be substantially perpendicular to upper surface 227. Each tab 228 also has a sloped surface 241. Tab 228 defines an angle φ between sloped surface 241 and upper surface 227. Angle φ may be any suitable angle. For example, angle φ may be between about fifty degrees and about ten degrees, between about forty degrees and about twenty degrees, or between about sixty degrees and about twenty degrees.

As discussed above, wash fluid can be directed out of either outlet 196 or outlet 206. Referring again to FIGS. 4 and 8, chamber 232 of spray arm 230 is configured for receipt of wash fluid from outlet 196. Main body 231 of spray arm 230 also defines an additional, secondary chamber 239 that is configured for receipt of wash fluid from outlet 206. During operation of dishwasher appliance 100, spray arm 230 rotates in a first direction when wash fluid is directed into chamber 232 of spray arm 230, and spray arm 230 rotates in a second direction when wash fluid is directed into additional chamber 239 of spray arm 230. The first direction is opposite to the second direction, e.g., the first direction may be clockwise and the second direction may be counter-clockwise or vice versa.

Main body 231 has a bottom surface 235 that faces mounting bracket 220 and/or base unit 210 when spray arm 230 is mounted to mounting bracket 220 and/or base unit 210. Main body 231 also defines a plurality of detents or axial slots 236 on bottom surface 235 of main body 231. Main body 231 may also include an engagement surface 250 positioned within each detent of plurality of detents 236 that, e.g., is substantially parallel to and positioned adjacent engagement surface 240 of tab 228 when spray arm 230 is secured to mounting bracket 220. Plurality of detents 236 is configured for receipt of tab 228 of mounting bracket 220 in order to assist in mounting spray arm 230 to mounting bracket 220 and/or hinder undesired detachment of spray arm 230 from mounting bracket 220 as discussed in greater detail below.

Spray arm 230 also includes a circular sidewall 237 that is mounted to main body 231 and extends away from bottom surface 235 of main body 231, e.g., downwardly along the axial direction A. A plurality of projections or radial tabs 238 is mounted to circular sidewall 237. Each projection of plurality of projections 238 extends away from circular sidewall 237, e.g., along the radial direction R. Further, each projection of plurality of projections 238 is configured for receipt within a respective channel of plurality of channels 225 of annular sidewall 222.

To mount spray arm 230 to mounting bracket 220, circular sidewall 237 of spray arm 230 may positioned against inner surface 223 of annular sidewall 222 and each projection of plurality of projections 238 may be received within a respective axial portion 270 of plurality of channels 225. Spray arm 230 may then be rotated relative to mounting bracket 220 such that each projection of plurality of projections 238 shifts from axial portion 270 of plurality of channels 225 to circumferential portion 272 of plurality of channels 225. As spray arm 230 is rotated, at least one tab 228 of mounting bracket 220 may also be received within one of plurality of detents 236.

FIG. 8 illustrates a partial, sectional view of spray assembly 180 with spray arm 230 mounted to mounting bracket 220. In FIG. 8, one of plurality of projections 238 is positioned within circumferential portion 272 of plurality of channels 225 and tab 228 of mounting bracket 220 is received within one of plurality of detents 236. As an example, plurality of projections 238 can hinder undesired rotation of spray arm 230 relative to mounting bracket 220 in a first direction (e.g., a clockwise direction), and tab 228 can hinder undesired rotation of spray arm 230 relative to mounting bracket 220 in a second direction that is opposite to the first direction (e.g., a counter-clockwise direction). Thus, plurality of projections 238 and tab 228 can assist with hindering undesired detachment of spray arm 230 from mounting bracket 220 by hindering rotation of spray arm 230 relative to mounting bracket 220 in both the first and second directions. In particular, without tab 228 disposed within one of plurality of detents 236, spray arm 230 could rotate in the second direction relative to mounting bracket 220, and such could cause spray assembly 180 to leak or cause spray arm 230 to work loose and detach from mounting bracket 220 over time.

In order to remove spray arm 230 from mounting bracket 220, each post of plurality of posts 226 is downwardly deflectable, e.g., along the axial direction A. Thus, to remove spray arm 230 from mounting bracket 220, post 226 may be deflected downwardly in order to remove tab 228 from detent 236. Spray arm 230 may then be rotated relative to mounting bracket 220 such that each projection of plurality of projections 238 shifts from circumferential portion 272 of plurality of channels 225 to axial portion 270 of plurality of channels 225. Spray arm 230 may then be lifted upwardly, e.g., along the axial direction A, to remove plurality of projections 238 from plurality of channels 225 and spray arm 230 from mounting bracket 220.

Referring briefly to FIG. 4, in exemplary embodiments, plurality of detents 236 is uniformly distributed on bottom surface 235 of main body 231 about the circumferential direction C. However, as discussed above, in exemplary embodiments, posts of plurality of posts 226 are non-uniformly distributed about the circumferential direction C. Thus, only one tab 228 is received within one of plurality of detents 236 when spray arm 230 is mounted to mounting bracket 220 as shown in FIG. 8. However, in alternative exemplary embodiments, multiple tabs 228 may be received within respective detents of plurality of detents 236 when spray arm 230 is mounted to mounting bracket 220.

It should be understood that the exemplary embodiment of spray assembly 180 shown in FIGS. 3-8 is provided by way of example only. In alternative exemplary embodiments, plurality of projections 238 may be mounted to annular sidewall 222 (e.g., on inner or outer surface 223 or 224 of annular sidewall 222) and plurality of channels 225 may be defined in circular sidewall 237. Similarly, tabs 228 may be mounted to spray arm 230 (e.g., on bottom surface 235 of main body 231) and plurality of detents 236 may be defined by plurality of posts 226 (e.g., on upper surface 227 of plurality of posts 226).

Referring now to FIGS. 7 and 8, in exemplary embodiments, adapter 182 may further include one or more tabs 280 which extend between and connect the mounting bracket 220 and the base unit 184. The tabs 280 may, for example, extend from end portion 207 of conduit 200 to mounting bracket 220. Accordingly, the mounting bracket 220 may advantageously be supported by the base unit 184 during assembly of the spray assembly 180.

Further, in exemplary embodiments, the mounting bracket 220 may be separable from the base unit 184. For example, the tabs 280 may be breakaway tabs which are removably connected to the mounting bracket 220 and/or the base unit 184. The mounting bracket 220 and/or the base unit 184 may be separated from the tabs 280 during assembly, such as upon and/or due to fastening of the spray arm 230 to the mounting bracket 220.

Notably, in exemplary embodiments, various components of an adapter 182 in accordance with the present disclosure are formed from the same material and are integral with each other. Components that are integral with each other are monolithic with no seams or junctions therebetween, and are typically formed together, i.e. through use of a single, continuous mold or through use of additive manufacturing. For example, the inlet housing 186, first conduit 190 and second conduit 200, along with other suitable components of the base unit 184, may be integral (and thus integrally formed) with each other. Further, the base unit 184, tabs 280 and mounting bracket 220 may be integral (and thus integrally formed) with each other, at least before the mounting bracket 220 and/or the base unit 184 are separated from the tabs 280.

Further, the present inventors have advantageously utilized current advances in additive manufacturing techniques to develop exemplary embodiments of such adapters 182 and components thereof in accordance with the present disclosure. For example, the inlet housing 186, first conduit 190 and second conduit 200, along with other suitable components of the base unit 184, may be formed through additive manufacturing. Further, the base unit 184 and mounting bracket 220, as well as the tabs 280, may be formed through additive manufacturing. While the present disclosure is not limited to the use of additive manufacturing to form such adapters 182 and components thereof generally, additive manufacturing does provide a variety of manufacturing advantages, including ease of manufacturing, reduced cost, greater accuracy, etc.

As used herein, the terms "additively manufactured" or "additive manufacturing techniques or processes" refer generally to manufacturing processes wherein successive layers of material(s) are provided on each other to "build-up", layer-by-layer, a three-dimensional component. The successive layers generally fuse together such as that a monolithic component is formed which may have a variety of integral sub-components. Suitable additive manufacturing techniques in accordance with the present disclosure include, for example, Fused Deposition Modeling (FDM), Selective Laser Sintering (SLS), 3D printing such as by inkjets and laserjets, Sterolithography (SLA), Direct Selective Laser Sintering (DSLS), Electron Beam Sintering (EBS), Electron Beam Melting (EBM), Laser Engineered Net Shaping (LENS), Laser Net Shape Manufacturing (LNSM) and Direct Metal Deposition (DMD).

Notably, the use of additive manufacturing to form adapters 182 and components thereof is particularly advantageous. For example, the relative angles and shapes of the conduits 190, 200 can advantageously be controlled when additive manufacturing is utilized in a manner that is superior to conventional manufacturing techniques, thus improving the design of the adapter 182 and resulting in reduced pressure losses therethrough. These characteristics of such adapters 182 are particularly advantageous over presently known conduits for flowing wash fluid to spray arms.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adapter for flowing wash fluid to a spray arm in a dishwasher appliance, the adapter defining an axial direction, a radial direction, and a circumferential direction, the adapter comprising:

a base unit, the base unit comprising an inlet housing defining an inlet annulus, a first conduit extending from the inlet housing and comprising a passage defined between an inlet and an outlet, and a second conduit extending from the inlet housing and comprising a passage defined between an inlet and an outlet, wherein the entire passage of the first conduit and the entire passage of the second conduit each extend at a discrete, non-parallel angle to the axial direction of less than or equal to 60 degrees, wherein the inlet of the first conduit is radially spaced apart from the inlet of the second conduit above the inlet annulus, and wherein the outlet of the second conduit surrounds the outlet of the first conduit.

2. The adapter of claim 1, wherein the entire passage of the first conduit and the entire passage of the second conduit each extend at an angle to the axial direction of less than or equal to 50 degrees.

3. The adapter of claim 1, wherein a cross-sectional area of the passage of the first conduit is generally constant throughout the passage from the inlet to the outlet.

4. The adapter of claim 1, wherein a cross-sectional area of the passage of the second conduit tapers throughout at least a portion of the passage towards the outlet.

5. The adapter of claim 1, wherein the inlet housing, first conduit and second conduit are integral with each other.

6. The adapter of claim 1, further comprising a mounting bracket, the mounting bracket comprising an annular sidewall which includes an inner surface and an outer surface, the annular sidewall defining a plurality of channels.

7. The adapter of claim 6, wherein the mounting bracket further comprises:

a post mounted to the annular sidewall and extending from the outer surface of the annular sidewall, the post having an upper surface; and a tab mounted on the upper surface of the post.

8. The adapter of claim 7, wherein the tab includes an engagement surface that is substantially perpendicular to the upper surface of the post.

9. The adapter of claim 7, wherein the tab includes a sloped surface that defines an angle $\varphi$ with the upper surface of the post, the angle $\varphi$ being between about fifty degrees and about ten degrees.

10. The adapter of claim 6, further comprising a plurality of tabs extending between and connecting the mounting bracket and the base unit.

11. The adapter of claim 10, wherein the mounting bracket is separable from the base unit.

12. The adapter of claim 6, wherein the base unit and mounting bracket are integrally formed through additive manufacturing.

13. A spray assembly for a dishwasher appliance, the spray assembly defining an axial direction, a radial direction, and a circumferential direction, the spray assembly comprising:

an adapter for flowing wash fluid to a spray arm in a dishwasher appliance, the adapter comprising:

a base unit, the base unit comprising an inlet housing defining an inlet annulus, a first conduit extending from the inlet housing and comprising a passage defined between an inlet and an outlet, and a second conduit extending from the inlet housing and comprising a passage defined between an inlet and an outlet, wherein the entire passage of the first conduit and the entire passage of the second conduit each extend at a discrete, non-parallel angle to the axial direction of less than or equal to 60 degrees; and a mounting bracket, the mounting bracket comprising an annular sidewall which includes an inner surface and an outer surface, the annular sidewall defining a plurality of channels; and a spray arm in fluid communication with the adapter, the spray arm removably fastened to the mounting bracket, wherein the inlet of the first conduit is radially spaced apart from the inlet of the second conduit above the inlet annulus, and wherein the outlet of the second conduit surrounds the outlet of the first conduit.

14. The spray assembly of claim 13, wherein the entire passage of the first conduit and the entire passage of the second conduit each extend at an angle to the axial direction of less than or equal to 50 degrees.

15. The spray assembly of claim 13, wherein a cross-sectional area of the passage of the first conduit is generally constant throughout the passage from the inlet to the outlet.

16. The spray assembly of claim 13, wherein a cross-sectional area of the passage of the second conduit tapers throughout at least a portion of the passage towards the outlet.

17. The spray assembly of claim 13, wherein the inlet housing, first conduit and second conduit are integral with each other.

18. The spray assembly of claim 13, further comprising a plurality of tabs extending between and connecting the mounting bracket and the base unit.

19. The spray assembly of claim 13, wherein the base unit and mounting bracket are integrally formed through additive manufacturing.

20. A dishwasher appliance comprising:

a tub that defines a wash compartment;

a rack assembly mounted within the wash compartment of said tub and configured for receipt of articles for washing; and a spray assembly for applying wash fluid to articles within said rack assembly, said spray assembly defining an axial direction, a radial direction, and a circumferential direction, said spray assembly comprising:

an adapter for flowing wash fluid to a spray arm in a dishwasher appliance, the adapter comprising:

a base unit, the base unit comprising an inlet housing defining an inlet annulus, a first conduit extending from the inlet housing and comprising a passage defined between an inlet and an outlet, and a second conduit extending from the inlet housing and comprising a passage defined between an inlet and an outlet, wherein the entire passage of the first conduit and the entire passage of the second conduit each extend at a discrete, non-parallel angle to the axial direction of less than or equal to 60 degrees; and a mounting bracket, the mounting bracket comprising an annular sidewall which includes an inner surface and an outer surface, the annular sidewall defining a plurality of channels; and a spray arm in fluid communication with the adapter, the spray arm removably fastened to the mounting bracket wherein the inlet of the first conduit is radially spaced apart from the inlet of the second conduit above the inlet annulus, and wherein the outlet of the second conduit surrounds the outlet of the first conduit.

* * * * *